US005343831A

United States Patent [19]

Collins

[11] Patent Number: 5,343,831

[45] Date of Patent: Sep. 6, 1994

[54] DYNAMIC AIR CLEANER AND CARBURETOR PRESSURIZATION SYSTEM FOR AIR COOLED INTERNAL COMBUSTION ENGINE

[75] Inventor: Imack L. Collins, Shreveport, La.

[73] Assignee: WCI Outdoor Products, Inc., Cleveland, Ohio

[21] Appl. No.: 115,910

[22] Filed: Sep. 1, 1993

[51] Int. Cl.[5] ..... F01P 7/04

[52] U.S. Cl. ..... 123/41.65; 123/198 E; 55/437; 55/DIG. 14; 55/DIG. 28

[58] Field of Search ..... 123/41.56, 41.63, 41.65, 123/41.7, 198 E; 55/DIG. 14, DIG. 28, 437, 438, 467

[56] References Cited

U.S. PATENT DOCUMENTS

| | | | |
|---|---|---|---|
| Re. 23,146 | 9/1949 | Packwood | 123/41.65 |
| 1,712,091 | 5/1929 | Pence . | |
| 2,585,083 | 2/1952 | Bouvy | 123/41.65 |
| 2,687,782 | 8/1954 | Sonderigger | 183/67 |
| 3,183,899 | 5/1965 | Tuggle | 123/41.65 |
| 3,252,449 | 5/1966 | Couchman, Jr. et al. | 123/41.65 |
| 3,426,513 | 2/1969 | Bauer | 55/459 |
| 3,581,717 | 6/1971 | Fullerton | 123/41.67 |
| 4,233,043 | 11/1980 | Catterson | 55/315 |
| 4,276,067 | 6/1981 | Lindman | 55/337 |
| 4,381,930 | 5/1983 | Hansen | 55/339 |
| 4,716,860 | 1/1988 | Henriksson et al. | 123/41.05 |
| 4,791,860 | 12/1988 | Verheijen | 99/323.3 |
| 4,838,908 | 6/1989 | Bader et al. | 55/385 |
| 4,841,920 | 6/1989 | Andreasson et al. | 123/41.66 |

*Primary Examiner*—Noah P. Kamen

*Attorney, Agent, or Firm*—Pearne, Gordon, McCoy & Granger

[57] ABSTRACT

A portable work producing apparatus, such as a chain saw, has an engine cooled by air from a blower driven by the engine. The engine's carburetor is pressurized with clean air from the blower. The blower includes a centrifugal impeller mounted within a fan housing having a set of blades for creating a vacuum to draw air into the housing. The impeller has a second set of relatively low-profile blades underneath the impeller for creating a vacuum under the impeller that draws air in through holes defined through the hub of the impeller. The air drawn through the holes is supplied to the carburetor. A circular screen extends from the axis of the impeller over the holes. Small particles entrained in the air stream entering the housing tend to be carried by the predominant portion of the stream into the housing. The screen is positioned and of a size that the trajectories of more massive particles entering the housing that are not blown into the housing bounce off the screen. Thus, the air delivered to the carburetor is relatively free from particles that would otherwise clog the air filter of the carburetor.

8 Claims, 1 Drawing Sheet

DYNAMIC AIR CLEANER AND CARBURETOR PRESSURIZATION SYSTEM FOR AIR COOLED INTERNAL COMBUSTION ENGINE

TECHNICAL FIELD OF THE INVENTION

The invention is concerned with an apparatus and method for removing solid airborne contaminants from combustion air supplied to the carburetor of an air cooled internal combustion engine that powers portable work producing apparatus such as chain saws.

BACKGROUND OF THE INVENTION

Engines used to power lawn, garden, and forestry equipment, such as chain saws, are often used in environments in which there is a large concentration of sawdust, dirt, and particulate contaminants. Without an air filter, dirt, dust, and other solid airborne contaminants drawn into the carburetor can become embedded in the oil film between the moving engine parts, thus creating an abrasive media that promotes engine failure. In environments having high concentrations of airborne contaminants, air filters clog more rapidly, thus obstructing air flow and decreasing engine performance unless changed frequently. Where dust and dirt are severe, larger filters are used to extend intervals between filter replacement. However, size and space on portable, hand-held equipment is a premium, and thus larger filters are somewhat undesirable. To enable use of smaller filters, without reducing maintenance intervals to replace filters, the carburetor and/or air filter of the engine are enclosed in a box that is pressurized with clean air to keep dirt and other contaminants away from the carburetor and its air filter. If the engine is fuel injected and has no carburetor, the pressurized box with an air filter is coupled to the intake port of the cylinder. The slight pressurization of the intake air also helps to improve performance of the internal combustion engine by delivering pressurized air to the carburetor so that the gas mixture load can be increased.

Two-stroke engines used on portable hand-held power equipment are air-cooled using air blown by a flywheel fan connected to the engine's crankshaft. Because weight, size and cost are critical constraints on design of engines for hand-held power tools, the relatively high velocity cooling air blown by the fan is a desirable source for air to pressure the carburetor or carburetor box. Unfortunately, air drawn into the fan is itself often contaminated with a considerable amount of dust or debris.

Two patents, U.S. Pat. No. 4,851,920 to Andreasson, et al. and U.S. Pat. No. 4,716,860 to Henriksson, et at., are examples of one approach to diverting a relatively contaminant-free portion of a high velocity air stream from fan to a carburetor. A plate along a portion of the periphery of a rotating fan impeller and parallel to the axis of rotation shields an inlet, located immediately behind the plate, to a duct leading to the carburetor port. The impeller imparts to particulate contaminants a centrifugal force that carries the contaminants radially away from the impeller. Due to the relatively higher inertia of the particles as compared to the air, the centrifugal forces carry the particles radially outwardly. Heavier particles, due to their inertia, do not easily bend around the plate and into the port. A stream of relatively high velocity air, relatively free of larger particles, is, however, capable of turning into the port and is thus diverted into the inlet. The port is connected by a tube to the carburetor. The particulate contaminants are carried away by the remainder of the air stream. A Jonsered Model 2051 chain saw improves on the Andreasson et at. design by placing a small ramp or "bump" at the leading edge of the plate, near the rotating fan blades. The bump on the leading edge of the duct inlet produces a lift which assists in deflecting airborne particulate contaminants away from the inlet.

There are problems with this design. The carburetor inlet duct in the flywheel fan housing interferes with the flow of cooling air out of the fan housing or volute. This interference reduces cooling of the engines. Under heavy loads and in the hot environment in which forestry, lawn and garden equipment sometime operate, the interference leads to engine overheating and failure. Due to its position, mounting of this design tends to be less than stable. Furthermore, the design is complicated and expensive to manufacture and assemble. It requires several additional components that must be manufactured to close tolerances and precisely aligned during assembly for satisfactory performance.

U.S. Pat. No. 4,233,043 to Catterson also relies on the relatively high inertia of the particulate matter to supply clean air to a carburetor duct. A duct projects into the side of a flywheel fan housing. The inlet to the duct is angled with respect to the flow of air so that the air being blown past the duct must undergo an abrupt change in direction in order to enter the duct. Particulate contaminants entrained in the air stream tend to be carried past the duct inlet due to their relatively high velocity. However, the Catterson et al. design is not able to provide a relatively high-velocity air stream for pressurizing a carburetor.

SUMMARY OF THE INVENTION

The invention provides an apparatus and method that separates particles from an a portion of an air stream in a blower without the noted disadvantages of the prior art.

According to a preferred embodiment of the invention, a centrifugal impeller has blades on each of its two sides. It is mounted for rotation in a fan housing that is divided into an upper and a lower chamber. The top side of the fan has substantially larger blades to create a vacuum to draw air through openings in fan housing. Most of the air flows radially outwardly in to the upper chamber of the fan housing, where it is directed into a stream of air for blowing across an internal combustion engine. The bottom blades are smaller and create a vacuum under the flywheel for drawing air through passages formed near the center of the flywheel's hub. Air drawn through passages is blown into a bottom chamber of the fan housing. A tube carries this air to a box for pressurizing the box with particle-free air to be mixed with fuel. A screen is mounted to the flywheel hub and extends over the passages. The air drawn through the passages is relatively clean. The trajectory of lighter particles that are entrained in air entering the fan housing for the flywheel fan are generally swept by the air into the upper portion of the fan chamber. The heavier particles that, due to their inertia, are not carried by the air into the upper portion of the fan housing are stopped from entering the passages in the hub of the flywheel by the screen. The heavy particles are deflected by the screen into the upper chamber of the fan housing.

The invention has several advantages. There are no obstructions in the flow of the cooling air to the engine. The apparatus is easily fabricated and assembled and requires relatively few additional parts and very little extra space and weight. No special alignment procedures are necessary for assembly. The apparatus is sturdy; engine vibration cannot cause misalignment.

According to other inventive aspects of the disclosed embodiment, the screen is a circular piece of mesh placed on top of the hub of the flywheel fan a predetermined distance above the openings in the hub. Rotating the screen with the flywheel imparts a centrifugal force to any particles clinging to the screen, thereby assisting in keeping the screen clean. The mesh screen allows air to flow relatively unobstructed into the openings while deflecting the larger particles. Furthermore, it is easily removed for cleaning or replacement. Bending the screen downward ensures deflection away from the openings of large particles following most of the possible trajectories through the fan housing and helps keep the screen cleaner by keeping the screen out of the major portion of the air flow through the impeller.

Other features and advantages of the invention will be evident from the preferred embodiment of the invention, which is described with reference to the following figures.

DETAILED DESCRIPTION OF THE PREFERRED EMBODIMENT

Figure 1:
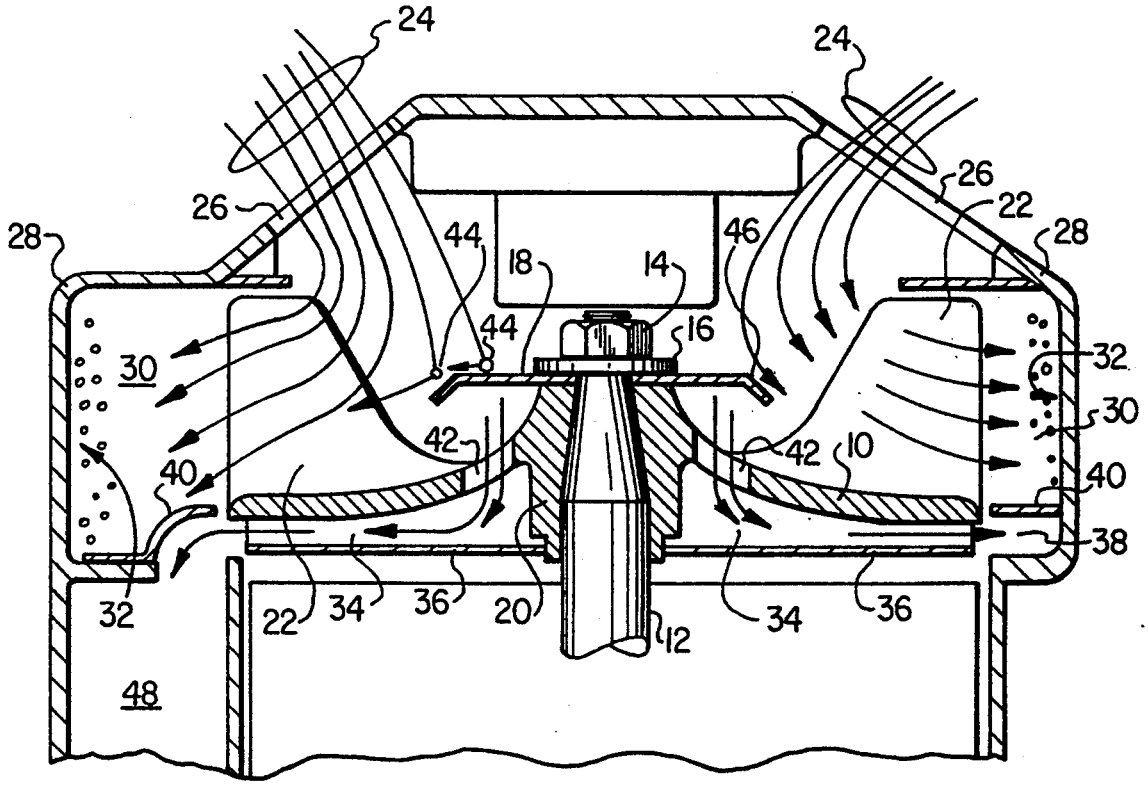
FIG. 1 is a cross-section of a fan housing of a portable work producing apparatus powered by an air-cooled internal combustion engine.

With reference to FIG. 1, flywheel fan 10 is secured to one end of crankshaft 12 of an air cooled, internal combustion engine. The flywheel is retained on the crankshaft in a conventional fashion with nut 14 screwed onto a threaded end of the crankshaft and locked with washer 16. A screen 18 is held between the washer and hub 20 of the flywheel so that it rotates with the flywheel. The screen is made of a relatively rigid mesh material, but potentially can be made of a solid material.

Upper impeller blades 20 on the flywheel form a primary centrifugal impeller that, when rotating, draws air (generally represented by arrows 24) through openings 26 over the flywheel fan in the top of fan housing 28 and blows it radially outwardly into upper chamber 30 of the fan housing. Lighter particles, indicated by dots 32, entering openings 26 are entrained in the air and carried into the upper chamber. The fan housing 28 has a conventional scroll-like shape of most blowers using centrifugal blowers that consolidates and directs the radially flowing air generally in the same direction for blowing toward and cooling the cylinder of the internal combustion engine.

Baffle 40 circumscribes the periphery of the flywheel fan 10 and divides the interior of the fan housing 28 into a lower chamber 38 and upper chamber 30. The bottom of the flywheel fan includes a second set of impeller blades 34 to form a secondary impeller. The blades have a relatively short profile as compared to primary impeller blades 22. The lower impeller blades rotate with the flywheel to generate a relatively small vacuum between the flywheel and baffle plate 36 in a lower chamber 38 of the fan housing. Baffle plate 36 is formed with the impeller. To simplify manufacture of the flywheel impeller, baffle 30 may be formed as a disc and attached to shaft 12 to rotate with the impeller or made part of the housing. If baffle plate 36 is made part of the housing, a small gap will exist between the bottom of the impeller blades and the baffle plate. The vacuum draws into hub openings 42 a relatively small amount of air through and/or around screen 18. Increasing the screen's height above the openings permits a significant amount of air to turn around the screen and flow into the hub openings.

The air drawn in through the hub openings tends to be relatively particle-free. Lighter particles tend to be swept into the upper chamber 30, as described. Heavier particles 44 are blocked by the screen 18 from entering the openings and deflected into upper chamber 30 to be blown out of the fan housing in the primary or engine-cooling air stream. The air flow into the hub openings is small compared to the air flowing through the upper chamber and thus will tend not to entrain any of the smaller particles that could otherwise flow through screen 18 if made of a mesh material. Furthermore, particles entrained in the air will not be able to turn abruptly with the air around the screen to enter the hub openings due to their inertia.

A portion 46 of screen 18 is bent downward to keep the screen out of the predominant flow of air (indicated by arrows 24) while deflecting heavier particles following most of the possible trajectories through the fan housing. The screen thus will not substantially interfere with the performance of the primary impeller. If the screen is made of mesh, the bend stiffens the screen and helps to keep the screen clean by keeping it out of the air stream that carries the smaller particles that could become lodged against or in the screen. Should the screen become clogged, its height above the openings still allows room for air to flow around the screen and into the openings. Centrifugal forces generated by the screen rotating with the fan also assist in throwing off particles on the screen to keep it clean. Air drawn into the bottom chamber 38 of the fan housing is directed into duct 48 to be blown into a pressurization box containing a carburetor for the internal combustion engine.

The invention and its advantages have been described with reference to a preferred embodiment. Persons in the art will recognize that numerous rearrangements, modifications and substitutions are possible without departing from the spirit of the invention. The foregoing 1 description is thus not be construed as limiting the invention to the embodiment described.

What is claimed is:

1. A blower for producing first and second high velocity air streams from a single air intake, the second high velocity air stream being substantially particle-free; the blower comprising:

a centrifugal impeller having on a front side blades arrayed about a hub, the centrifugal impeller mounted within a fan housing for rotation to draw in air through an air intake located above the hub in fan housing and into the center of the impeller, and to blow the air radially outwardly into the fan housing to create a first high velocity air stream;

an opening defined through the hub for communicating air from the front of the centrifugal impeller to a back side of the first impeller;

a second impeller positioned for rotation on the back side of the centrifugal impeller, the second impeller creating a vacuum in the vicinity of the opening in the hub of the first impeller that draws air from the front side of the centrifugal impeller into the second impeller for creating a second high velocity air stream; and a screen extending radially outwardly from the hub's center and over the opening; the screen having a size and position whereby it does not substantially interfere with air flowing from the intake of the housing to the first impeller but permits some air to flow into the hub opening; whereby smaller particles tend to be carried with the air into the first impeller, away from the hub opening; and whereby larger particles that are not carried with the air deflect off the screen and into the first impeller; the screen and the hub opening thereby cooperating to produce a generally particle-free second air stream.

2. The apparatus of claim 1 wherein the screen is a mesh having holes large enough to allow some flow of air through the screen but small enough to block larger particles not expected to be entrained in the air flowing from the intake of the housing to the first impeller.

3. The apparatus of claim 1 wherein the screen is made of a solid material and is positioned a predetermined distance above the hub opening that allows a relatively abrupt turn in direction of air flow around the screen and into the hub opening, where the abruptness is sufficient to discourage entraining of particles in the air flow around the screen.

4. A portable work producing apparatus powered by an air-cooled internal combustion engine comprising:

a centrifugal impeller rotated about an axis by an internal combustion engine; the impeller having a hub, a first set of blades on its front side, a second set of blades on its backside and at least one opening through the hub through which air is communicated;

a screen extending substantially radially outwardly a predetermined distance from the hub on the front side of the impeller, over the opening in the hub; and a fan housing in which the impeller is rotated; the fan housing having a first chamber in which the first set of blades rotates and a second chamber in which the second set of blades rotates; the first chamber having openings above the axis of the impeller through which air is drawn by a vacuum created during rotation of the impeller and blown toward an exit of the fan housing for use in cooling the engine; the second chamber having an exit for communicating air blown by the second set of blades to a charge intake system of the engine;

wherein the second set of blades creates, when the impeller rotates, a vacuum on the backside of the impeller such that air is drawn through the hub opening and blown into the second chamber; and wherein the air drawn through the hub opening is relatively free from particles that enter the inlets in the first chamber due to particles having relatively small mass remaining entrained in air blown by the first set of blades into the first chamber and particles having larger masses bouncing off the screen over the opening and into the first chamber.

5. The apparatus of claim 4 wherein the screen is mesh having openings large enough to allow a flow of air through the screen but small enough to block relatively large particles that are not likely to be entrained in the air blown by the first set of blades into the first chamber.

6. The apparatus of claim 5 wherein the screen rotates with the impeller.

7. The apparatus of claim 4 wherein the screen has radial dimension large enough to block trajectories of particles entering the openings in the first chamber but small enough not to substantially extend into a predominant portion of air stream flowing through the openings in the first chamber and into the first set of blades.

8. The apparatus of claim 7 wherein the screen bends downwardly, away and substantially out of the air stream from the openings in the first chamber.

* * * * *